US005411295A

United States Patent [19]

Bates et al.

[11] Patent Number: 5,411,295

[45] Date of Patent: May 2, 1995

[54] TAMPER-EVIDENT LABEL

[75] Inventors: Scott B. Bates, Ontario; Jean E. Haghani, West Covina, both of Calif.

[73] Assignee: Avery Dennison, Pasadena, Calif.

[21] Appl. No.: 963,092

[22] Filed: Oct. 19, 1992

[51] Int. Cl.[6] ..... B42D 15/00

[52] U.S. Cl. ..... 283/81; 283/105; 283/901; 283/94; 283/96; 40/310

[58] Field of Search ..... 283/101, 105, 108, 110, 283/111, 901, 72, 81, 94, 96; 40/299, 310, 630; 428/915, 916

[56] References Cited

U.S. PATENT DOCUMENTS 3,740,081 6/1973 Whipperman .
4,335,172 6/1982 Sato .
4,424,911 1/1984 Resnick .
4,608,288 8/1986 Spindler .
4,652,473 3/1987 Han .
4,674,771 6/1987 Thompson, II .
4,837,061 6/1989 Smits et al. .
4,986,429 1/1991 Singleton, Jr. .
5,013,088 5/1991 Marin ..... 283/105

*Primary Examiner*—Willmon Fridie
*Attorney, Agent, or Firm*—Poms, Smith, Lande & Rose

[57] ABSTRACT

A tamper-evident label is disclosed having a base label substrate with an adhesive on its lower surface. Water-insoluble indicia are applied to the upper surface of the base label substrate. Water-soluble indicia or graphics are applied to at least the water-insoluble indicia. When exposed to water, the water-soluble indicia or graphics dissolve, and the water-insoluble indicia are revealed. The label further includes a plurality of perforations such that removal of the label from an application surface causes the label to fragment.

25 Claims, 1 Drawing Sheet

FIG. 1
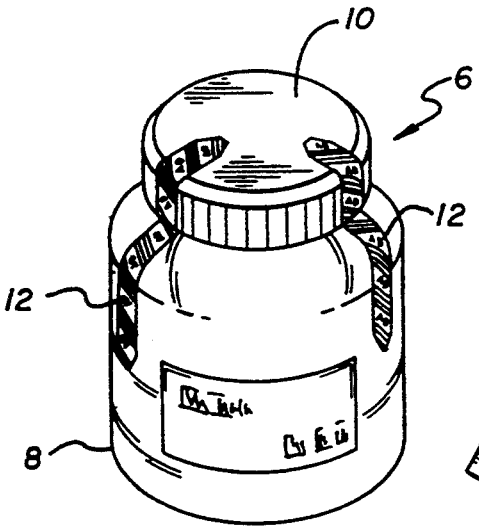
FIG. 2
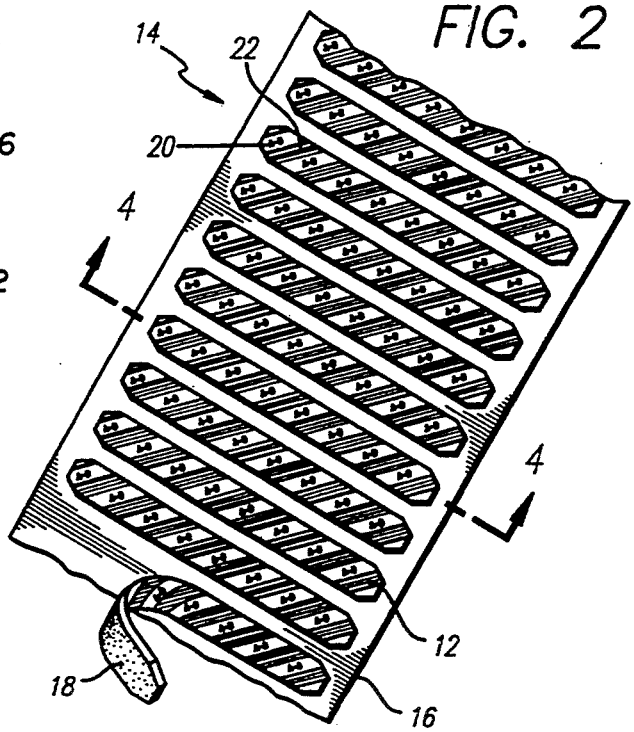
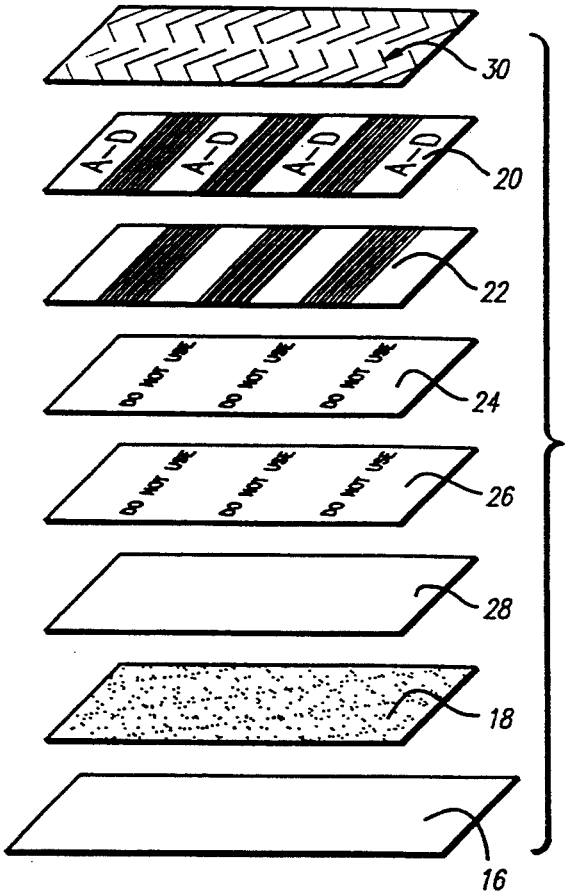
FIG. 3
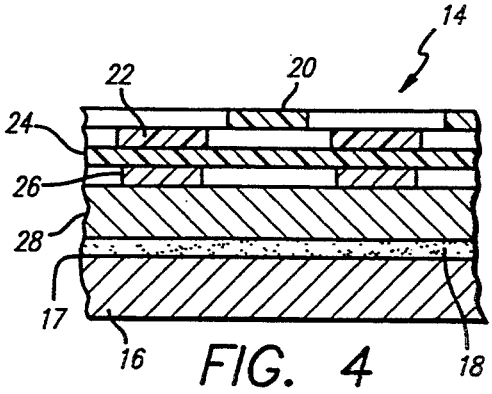
FIG. 4
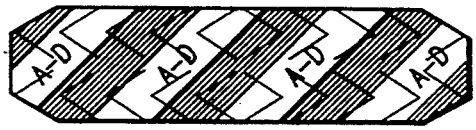
FIG. 5
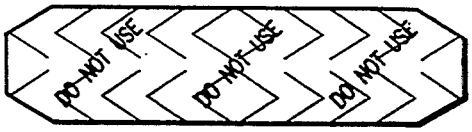
FIG. 6

TAMPER-EVIDENT LABEL

FIELD OF THE INVENTION

This invention relates in general to labels and, more particularly, to labels for detecting and evidencing tampering.

BACKGROUND OF THE INVENTION

Tampering with products is an escalating and serious problem which may result in serious harm and even death to the unwary consumer. Most of the protective methods available today can be easily circumvented by the tampering sophisticate. Unfortunately, protective labels can be soaked off of a container using water, the container opened, harmful substances added, and the protective label reattached without clearly indicating that tampering has occurred.

A well-accepted method for providing limited protection against container tampering employs a perforated label structure which, when removed from a container, fragments and disintegrates, such as the label disclosed by U.S. Pat. No. 5,013,088 (Marin, 7 May 1991). Another popular design, as described in U.S. Pat. No. 4,652,473 (Han, 24 Mar. 1987), utilizes a multiple layer amorphous polymer construction which delaminates when the label is removed from a surface to which it is adhered. These designs, however, fail to indicate that tampering by means of water immersion has occurred. A label, used in blind clinical studies, that reacts with water by dissolving a rice paper layer and exposing underlying medical information, is disclosed by U.S. Pat. No. 3,740,081 (Whipperman, 19 Jun. 1973). This label is employed to preserve the privacy of the underlying medical information, rather than protecting containers from illicit tampering. Designs similar to those disclosed by Marin and Han have an additional disadvantage in that, given sufficient skill and patience, the protective label can be reapplied to the container after the tampering act is accomplished, thus providing a false indication of the integrity of the product.

Therefore, there is a need for a sophisticated tamper-evident label that will clearly indicate to the consumer that tampering of the container has occurred.

Accordingly, one object of the present invention is to clearly communicate to the consumer that tampering of the label by means of water immersion has occurred.

SUMMARY OF THE INVENTION

In accordance with one aspect of the invention, a tamper-evident label includes a base label substrate with an adhesive on its lower surface. Water-insoluble indicia are applied to the upper surface of the base label substrate. Water-soluble graphics are applied to at least the water-insoluble indicia.

The label can be applied to a container via the adhesive layer. Attempted tampering by means of water immersion will cause the water-soluble graphics to dissolve, thereby exposing the water-insoluble warning indicia. Any attempt to remove the label from the container will cause the label to fragment and disintegrate.

In accordance with another feature of the invention, the label as described hereinabove may be provided with an aggressive permanent adhesive to secure the label to a container such that attempting to remove the label from the container will cause the relatively weak base label substrate to tear before the adhesive detaches.

Other aspects of the invention involve the printing of indicia on the upper surface of the base label substrate. The indicia may be imprinted with water-insoluble ink and include a message indicating that tampering has occurred. Water-soluble indicia or graphics may be applied to mask or cover the water-insoluble indicia. Additional water-soluble indicia may be applied to the upper surface of the base label substrate providing identifying information, such as the label or product manufacturer.

Another aspect of the invention involves a plurality of perforations cut into the base label substrate such that the label fragments when an attempt is made to remove the label from a surface to which it is adhered.

It is further noted that a plurality of labels of the type described hereinabove may be mounted on a backing strip with a release coating between the backing strip and the pressure sensitive adhesive on the labels so that the labels may be dispensed over a peeling blade from a roll in the conventional manner.

One specific embodiment of the label illustrating the principles of the invention involves an elongated strip label intended to extend from the body of a bottle onto the cap thereof. A series of the labels may be mounted on a backing sheet having a release coating thereon. Each of the labels may have an aggressive, permanent pressure sensitive adhesive thereon facing the backing sheet, and may be provided with a series of transverse die cuts to prevent integral removal of the label from the bottle. In addition, the label may have initial water-insoluble warning indicia or graphics on it, and may then be coated or printed with water-soluble coatings or graphics to obscure the water-insoluble warning graphics and to provide normal label information. A transparent or pigmented, opaque water-soluble layer may be included over the basic water-insoluble warning indicia or graphics, and other water-soluble graphics may be located to precisely cover the warning graphics or to provide the normal label information either across the entire label, or between the areas where the warning graphics are obscured.

Further scope of applicability of the present invention will become apparent from the detailed description provided hereinafter. It should be understood, however, that the detailed description and specific examples, while indicating preferred embodiments of the invention, are given by way of illustration only, since other objects, features, and advantages within the scope and spirit of the invention will become apparent from a consideration of the following detailed descriptions and from the accompanying drawings.

BRIEF DESCRIPTION OF THE DRAWINGS

FIG. 1 shows two tamper-evident labels on a container covered by a secured cap;

FIG. 2 shows an array of tamper-evident labels on a length of releasable backing sheet;

FIG. 3 shows a diagrammatic representation of the various components or method steps involved in the formation of an individual tamper-evident label;

FIG. 4 shows a cut-away or cross-sectional diagrammatic representation of a tamper-evident label;

FIG. 5 shows a tamper-evident label prior to exposure to water; and

FIG. 6 shows a tamper-evident label after exposure to water.

DETAILED DESCRIPTION OF THE PREFERRED EMBODIMENT

Referring more particularly to the drawings, FIG. 1 shows a product container 6 including a containment vessel 8 and removable covering lid 10. Two tamper-evident labels 12 are shown attached to the product container 6. A portion of the tamper-evident label 12 is shown adhered to the outside contour of the containment vessel 8. The remaining portion of the tamper-evident label 12 is shown adhered to the outside contour of the removable covering lid 10.

FIG. 2 shows an array of tamper-evident labels 14 affixed to a releasable backing sheet 16. A permanent pressure sensitive adhesive 18 covers the bottom surface of the tamper-evident label 12 which is releasably affixed to the releasable backing sheet 16. In accordance with the usual practice in the manufacturer of labels, the tamper-evident label 12 can be easily removed from the releasable backing sheet 16 with relatively low peel force and no fragmentation of the label 12.

FIG. 3 shows a top-view diagrammatic representation of a tamper-evident label such as the label 12 pictured in FIG. 1. FIG. 3 depicts the constituent elements or successive steps going into the fabrication of the tamper-evident label, rather than its true physical construction. The successive showings in FIG. 3, going upward, give the appearance of the label after successive coating, marking, or other steps. The lower surface of the base label substrate 28 is coated with a permanent pressure sensitive adhesive 18. The pressure sensitive adhesive 18 preferably has an adhering power such that attempting to remove the label from a surface to which it is adhered will cause the label to fragment before the pressure sensitive adhesive 18 detaches. A releasable backing sheet 16 is shown immediately below the pressure sensitive adhesive layer 18.

The water-insoluble warning graphics 26 are applied to the upper surface of the base label substrate 28. An optional water-soluble coating 24 is applied over the base label substrate 28, including the warning graphics 26. The water-soluble coating 24 may be transparent or may include pigment to make it opaque.

Water-soluble masking graphics 22 are applied over the warning graphics 26. The masking graphics 22 are applied over the warning graphics 26 in a manner such that the warning graphics 26 are completely masked by the masking graphics 22.

The water-soluble information graphics 20 are next applied to the label. The information graphics 20 may be applied to the label in a manner such that the information graphics 20 are located in areas free of the masking graphics 22. Alternatively, the masking graphics 22 may be a full layer, with the information graphics 20 being a contrasting color.

The tamper slits 30 form a plurality of transverse perforations stamped or die cut through the base label substrate 28. The geometry of the tamper slits 30 and the relative separation distance between adjacent perforations cause the label to fragment and disintegrate upon removal from an application surface, providing clear evidence of tampering.

Turning now to FIG. 4, this figure shows a diagrammatic representation, rather than a true representation, of a cut-away or cross sectional view of the tamper-evident label assembly 14 pictured in FIG. 2. The pressure sensitive adhesive layer 18 is located between the releasable backing sheet 16 and the base label substrate 28. An adhesive-release coating 17, typically a silicone based material, covers the upper surface of the releasable backing sheet 16. The pressure sensitive adhesive 18 is preferably of a type known as "permanent" self-adhesive material. Using standard measuring techniques in accordance with Pressure Sensitive Tape Council standards, permanent adhesives will normally have a peel force of three to four or more pounds per one inch strip measured perpendicular to the orientation of the tape on a stainless steel base member, while removable self-adhesive materials normally have a peel force of less than approximately two pounds. Characteristically, with permanent adhesives, the label or the underlying base material will not maintain structural integrity and will normally fragment or disintegrate before detaching from the application surface. The releasable backing sheet 16, however, provides an adhesive-release coating 17 between the pressure sensitive adhesive layer 18 and the releasable backing sheet 16 such that the tamper-evident label can be easily removed from the releasable backing sheet 16 with relatively low peel force and no fragmentation of the tamper-evident label. When soaked in water, however, for extended periods of time, normal labels, even when secured with permanent pressure sensitive material, may be removed.

In a preferred embodiment, the base label substrate 28 is fashioned from low internal strength paper through which tamper slits 30, as shown in FIG. 3, are die cut, such that removal of the tamper-evident label from a surface to which it is permanently adhered will cause the label to tear before the pressure sensitive adhesive 18 detaches. Appropriate base label substrate paper can be obtained from Fasson Roll Materials Division, 7670 Auburn Rd., Painesville, Ohio 44077.

The warning graphics 26 are applied to the upper surface of the base label substrate 28. Preferably, the warning graphics 26 would contain a warning message indicating that tampering of the container has occurred and that the container contents should not be used. The warning graphics 26 would be substantially water-insoluble such that the warning graphics 26 do not dissolve when exposed to water. Appropriate water-insoluble ink can be obtained, for example, from Werneke & Mulheran Inc., 820 Eubanks Dr., Vacaville, Calif. 95688.

An optional water-soluble coating 24 is applied to the base label substrate 28 and the warning graphics 26. The masking graphics 22 are next applied over the warning graphics 26. In a preferred embodiment, the masking graphics 22 are of a "candy stripe" configuration as pictured on the label 12 in FIG. 2. The masking graphics 22 are registered with the warning graphics 26 such that the masking graphics 22 cover at least the warning graphics 26.

In areas being free of the masking graphics 22, information graphics 20 are applied to the label. In a preferred embodiment, the information graphics 20 would contain indicia identifying the label manufacturer or container contents manufacturer. Appropriate graphics ink for this purpose can be obtained from CPI, Ltd., 2275 Manya St., San Diego, Calif. 92154 or Midland Color, 1850 Tapo St., Simi Valley, Calif. 93063.

The optional water-soluble coating 24 provides a dissolvable interface between the water-insoluble warning graphics 26 and the water-soluble masking graphics 22 and information graphics 20. The water-soluble coating 24, masking graphics 22, and information graphics 20 are preferably applied using a polyvinyl alcohol resin based ink which dissolves when exposed to water. One appropriate polyvinyl alcohol resin for this purpose is Vinex 2019 resin which can be obtained from Air Products and Chemicals, 7201 Hamilton Blvd., Allentown, Pa. 18195.

When the tamper-evident label is exposed to water, the polyvinyl alcohol resin based masking graphics 22, information graphics 20, and water-soluble coating 24 dissolve. The water-insoluble warning graphics 26 become visible instructing the consumer to avoid using the product. The tamper slits 30, pictured in FIG. 3, have a secondary feature of accelerating water ingression into the tamper-evident label structure.

FIG. 5 shows a top-view of an individual tamper-evident label prior to exposure to water. In contrast, FIG. 6 shows the same individual tamper-evident label after exposure to water. The water-soluble information graphics 20, water-soluble masking graphics 22, and water-soluble coating 24, as pictured in FIG. 4, have completely dissolved, thereby exposing the waterproof warning graphics and evidencing the occurrence of tampering.

While the dimensions of the labels are not critical, in this case the labels were about ⅜ of an inch in width and approximately 2 ½ inches in length. In general, when the strip type labels are used as shown in FIG. 1, their length is usually more than four times longer than their width.

It is to be understood that the disclosed label construction is merely illustrative of the principles of the present invention which could be implemented by other types of structures constructed of different materials. Thus, by way of example and not of limitation, other water-soluble and water-insoluble inks and graphics could be used. Furthermore, various graphics configurations could likewise be selected. Instead of a strip configuration, the labels could be round, square, or have other forms depending on the application. Accordingly, the scope of the present invention is not limited to the embodiments shown in the drawings and specifically described herein above.

What is claimed is:

1. A tamper-evident label for application to a container to indicate that tampering has occurred, comprising:

a base label substrate having an upper surface and a lower surface;

an adhesive applied directly on said lower surface for attachment to said container, the adhesive being a permanent pressure sensitive adhesive;

warning graphics in substantially water insoluble ink printed directly on portions of said upper surface, other portions of said upper surface being free of said warning graphics, said warning graphics including indicia indicating that tampering has occurred;

masking graphics of substantially water-soluble ink at least covering said warning graphics printed directly on said warning graphics a plurality of perforations through said base label substrate, such that removal of said label from said container will cause said label to fragment evidencing tampering before said permanent pressure sensitive adhesive detaches; and the paper content of said tamper evident label consisting solely of a paper layer forming said base label substrate.

2. A tamper-evident label as claimed in claim 1, comprising a substantially transparent water-soluble coating covering at least said warning graphics.

3. A tamper-evident label as claimed in claim 2, wherein said water-soluble coating is substantially translucent.

4. A tamper-evident label as claimed in claim 1, wherein said permanent pressure sensitive adhesive has an adhering power such that attempting to remove said label from said container will cause said label to fragment before said permanent pressure sensitive adhesive detaches.

5. A tamper-evident label as claimed in claim 1, further comprising information graphics in substantially water-soluble ink printed directly on portions of said upper surface, said information graphics located in said free portions.

6. A tamper-evident label as claimed in claim 1, whereby said warning graphics are alternately positioned on said upper surface between said free portions.

7. A tamper-evident label as claimed in claim 1, whereby said masking graphics are alternately positioned on said upper surface covering at least said warning graphics.

8. A tamper-evident label as claimed in claim 1, wherein said information graphics are visible on said label, until said label has been exposed to water, thereby making visible previously masked said warning graphics.

9. A tamper-evident label as defined in claim 1, wherein said warning graphics ink contains opaque pigmentation.

10. A tamper-evident label as claimed in claim 1, wherein said masking graphics ink contains opaque pigmentation.

11. A tamper-evident label as claimed in claim 1, wherein said base label substrate is fashioned from low internal strength paper stock.

12. A tamper-evident label for application to an object, comprising:

a base substrate having an upper surface and a lower surface;

an adhesive applied directly on said lower surface for attachment to said object;

substantially water-insoluble warning indicia applied directly on said upper surface;

substantially water-soluble graphics printed directly on said warning indicia covering at least a substantial portion of said water-insoluble warning indicia; and the only integral solid state layer included in said tamper evident label consisting of the layer forming said base substrate.

13. A tamper-evident label as claimed in claim 12, wherein said water-insoluble indicia consists of undisclosed information, and said water-soluble graphics consists of observable information.

14. A tamper-evident label as claimed in claim 13, wherein said water-insoluble indicia consists of undisclosed warning information, and said water-soluble graphics consists of observable benign information, whereby only said observable benign information is visible on said label, until said observable benign information dissolves after said label has been exposed to water, thereby revealing said warning information.

15. A tamper-evident label as claimed in claim 12, comprising a substantially transparent water-soluble coating applied to at least said warning graphics.

16. A tamper-evident label as claimed in claim 12, wherein said base substrate has a plurality of perforations therethrough, such that removal of said label from said object will cause said label to fragment evidencing tampering before said permanent adhesive detaches.

17. A tamper-evident label as claimed in claim 12, wherein said adhesive on said lower surface is a pressure sensitive adhesive having a permanent adhering power such that attempting to remove said label from said object will cause said label to fragment evidencing tampering before said pressure sensitive adhesive detaches.

18. A multiple layer tamper-evident label assembly comprising:

releasable backing sheet; and a plurality of tamper-evident labels affixed to said backing sheet, each said label having an upper surface and a lower surface, and including:

a pressure sensitive adhesive applied directly on said lower surface for affixing said label to said releasable backing sheet;

said label having warning graphics in substantially water-insoluble ink printed directly on portions of said upper surface, other portions of said upper surface being free of said warning graphics, said warning graphics including indicia indicating that tampering has occurred;

said label having masking graphics in substantially water-soluble ink printed directly on warning graphics at least covering said warning graphics; and information graphics in substantially water soluble ink printed directly in said free portions;

the only integral solid state layer included in said tamper evident label consisting of the layer forming said base substrate.

19. A label assembly as claimed in claim 18, comprising a substantially water-soluble transparent coating applied to at least said warning graphics.

20. A label assembly as claimed in claim 18, wherein said pressure sensitive adhesive is an aggressive permanent adhesive having an adhering power such that attempting to remove said label from an application surface will cause said label to fragment evidencing tampering before said pressure sensitive adhesive detaches.

21. A label assembly as claimed in claim 18, whereby said warning graphics are alternately positioned on said upper surface between said free portions.

22. A label assembly as claimed in claim 18, whereby said masking graphics are alternately positioned on said upper surface between said free portions covering at least said warning graphics.

23. A label assembly as claimed in claim 18, wherein at least said label has a plurality of perforations therethrough, such that removal of said label from a surface to which it is permanently adhered will cause said label to fragment evidencing tampering before said pressure sensitive adhesive detaches.

24. A label assembly as claimed in claim 18, wherein said labels are fashioned into elongated strips each having a length at least four times greater than their width.

25. An assembly including a tamper-evident label for indicating that tampering has occurred, comprising:

a container;

a container closure; and a tamper evident label adhesively secured to both said container and closure, said label comprising:

a base label substrate having an upper surface and a lower surface;

an adhesive layer applied directly on said lower surface for attachment to said container, the adhesive being a permanent pressure sensitive adhesive;

warning graphics in substantially water insoluble ink printed directly on portions of said upper surface, other portions of said upper surface being free of said warning graphics, said warning graphics including indicia indicating that tampering has occurred;

masking graphics of substantially water-soluble ink at least covering said warning graphics printed directly on said warning graphics; and the only integral solid state layer included in said tamper evident label consisting of the layer forming said base substrate.

* * * * *